US011512931B2

(12) United States Patent
Merritt, II et al.

(10) Patent No.: US 11,512,931 B2
(45) Date of Patent: Nov. 29, 2022

(54) SYSTEMS AND METHODS FOR BLAST CONTROL

(71) Applicant: Blast Control Systems, LLC, Kilgore, TX (US)

(72) Inventors: Thomas Merritt, II, Kilgore, TX (US); Richard Rossow, Longview, TX (US); Landon Foster, Kilgore, TX (US); Chester Whinery, Mineola, TX (US)

(73) Assignee: Blast Control Systems, LLC, Kilgore, TX (US)

( * ) Notice: Subject to any disclaimer, the term of this patent is extended or adjusted under 35 U.S.C. 154(b) by 0 days.

(21) Appl. No.: 16/820,612

(22) Filed: Mar. 16, 2020

(65) Prior Publication Data

US 2021/0278176 A1 Sep. 9, 2021

Related U.S. Application Data

(60) Provisional application No. 62/818,384, filed on Mar. 14, 2019.

(51) Int. Cl.

| | |
|---|---|
| ***F41H 5/013*** | (2006.01) |
| ***F41H 5/007*** | (2006.01) |
| ***F42D 5/05*** | (2006.01) |

(52) U.S. Cl.

CPC ..... *F41H 5/013* (2013.01); *F41H 5/007* (2013.01); *F42D 5/05* (2013.01)

(58) Field of Classification Search

CPC ..... F41H 5/007; F41H 5/013; F42D 5/05

USPC ..... 86/50; 89/36.02, 36.04, 36.07, 902, 918, 89/937, 939; 102/303

See application file for complete search history.

(56) References Cited

U.S. PATENT DOCUMENTS

| | | | | | |
|---|---|---|---|---|---|
| 5,377,577 | A * | 1/1995 | Bounkong | F41H 5/08 | 2/2.5 |
| 5,939,658 | A * | 8/1999 | Muller | F41H 5/08 | 89/36.04 |
| 6,807,890 | B1 * | 10/2004 | Fuqua | F41H 5/08 | 89/36.02 |
| 7,389,718 | B1 * | 6/2008 | Carter | F41H 1/02 | 2/2.5 |
| 7,520,207 | B1 * | 4/2009 | Fuqua | F41H 5/013 | 109/82 |
| 7,980,166 | B1 * | 7/2011 | Fuqua | F41H 5/24 | 89/36.07 |
| 8,573,125 | B1 * | 11/2013 | Rossow | F42D 5/05 | 102/303 |
| 2004/0107823 | A1 * | 6/2004 | Kiley | B65D 90/325 | 86/50 |
| 2010/0043629 | A1 * | 2/2010 | Carberry | F41H 5/08 | 89/36.02 |
| 2010/0275764 | A1 * | 11/2010 | Egres, Jr. | D03D 15/267 | 89/36.02 |
| 2014/0174284 | A1 * | 6/2014 | Peters | B63B 17/02 | 89/36.02 |
| 2018/0156577 | A1 * | 6/2018 | Navin | F41H 5/023 | |
| 2018/0306555 | A1 * | 10/2018 | Bannon | F41H 5/026 | |

* cited by examiner

*Primary Examiner* — Bret Hayes

(74) *Attorney, Agent, or Firm* — Bell Nunnally & Martin LLP

(57) ABSTRACT

A relatively lightweight, modular, blast control system utilizes a plurality of fabric panels that may be joined to form a matrix to protect or control a blast.

14 Claims, 6 Drawing Sheets

SYSTEMS AND METHODS FOR BLAST CONTROL

CROSS-REFERENCE TO RELATED APPLICATION

The present application claims the benefit under 35 U.S.C. § 119(e) of U.S. Provisional Patent Application No. 62/818,384 filed Mar. 14, 2019, which is incorporated herein by reference in its entirety as if fully set forth herein.

TECHNICAL FIELD

The invention relates generally to systems and methods for containing projectiles dispersed from explosive blasts, high pressure releases, and, more particularly, to systems and methods for using blast control blankets to protect various environments.

BACKGROUND

In industries where equipment is operated under pressure or pressure testing may be necessary, it is common to build blast mitigation and protection systems to place equipment in while being pressure tested. In addition, there may be circumstances where equipment may be tested which may result in situations where flying objects of small to significant size and velocities up to 1000 feet per second or more are produced, thus also needing protection.

Similarly, in inherently dangerous industries where there is potential for dangerous explosions or blasts such as oil and gas exploration and production, blast mitigation and protection systems are commonly used to protect critical equipment from damage as well as to help mitigate serious bodily injury or death to operators and other employees who must perform duties in and around the well. Examples of such inherently dangerous situations are high pressure equipment located on offshore oil rigs and high pressure equipment utilized during the hydraulic fracturing process on onshore oil & gas well sites. During operation and pressure testing of such equipment, application of a blast mitigation system is necessary in the event an equipment failure or explosive incident occurs.

Further still, there is a general need for explosive or blast protection for equipment or structures in light of various dangers that could pose a threat to these critical assets. All of these scenarios share a need for protection from the highly dangerous situations created by explosive blasts and the ensuing fragments and projectiles.

In the past, various patents have issued relating to apparatuses and methods for providing blast protection or containment utilizing various forms of blankets, tarps and other protective structures. Typically, such apparatuses utilize a modular system comprising a series of panels that are joined together in various fashions to form a unitary blast control blanket suitably sized for providing adequate protection of a critical piece of equipment. However, it is known in the art that such modular systems either suffer from bulky, cumbersome, and frustratingly inconvenient methods for joining various panels together. Such connection methods detract from the overall portability of the protection system, as assembly and disassembly may be time consuming for an operator and is more prone to incorrect assembly.

Furthermore, such prior art modular protection systems typically suffer from substantially weakened protection at the connection points themselves, as the connections are inevitably the weakest portion of an assembled blast control system.

For example, U.S. Pat. No. 3,491,847 to Abbott, which is incorporated herein by reference, discloses an explosion cover which constitutes a protective pad adaptable to be secured to a vehicle. The pad includes an elongated sleeve enclosing a stack of flexible ballistic plastic textile material sheets. However, the cover described in Abbott is of a custom size and inconvenient in that the cover must be appropriately sized to the application to be used, and cannot be easily adapted to different size requirements without fabricating an entirely new cover from scratch. Furthermore, Abbott discloses the use of leather straps for extending from the pad for securing the pad to the equipment to be protected.

U.S. Pat. No. 3,870,256 to Mazzella, which is incorporated herein by reference, teaches a wire net structure for heavy-duty use which comprises a rectangular mesh of diagonally intersecting wire elements framed by a peripheral cable passing through a set of eyes on each side of the rectangle. Mazzella further teaches that the wire net structure may be used as a blasting mat, several of which may be joined together adjacent one another around a conduit in danger of rupture, the meshing wire elements sliding freely past one another. However, the wire net structure disclosed in Mazzella is heavy and cumbersome to join, while also failing to provide sufficient blast protection in that the wire mesh may easily be penetrated with ballistic matter. Further, the method of joining various wire panels together in Mazzella results in weaker blast protection at the points where the wire net structures are connected to one another.

U.S. Pat. No. 4,590,714 to Walker, which is incorporated herein by reference, discloses an insulating tarp made from two membranes which sandwich an insulating material made from fiber glass. The tarp contains a seam structure around all four edges of the tarp which not only fastens the two membranes together, but also holds the highly resilient insulating material in position. At least two adjacent edges of the tarp include a flap that extends along the seam structure along each of the edges. The edges include grommets at regular intervals used to interconnect several of the tarps together. However, the connectors and anchoring system for the tarp disclosed in Walker are substantially weaker than the tarp itself, and thus would fail in the event the tarp of Walker was used to contain large, high energy projectiles.

U.S. Pat. No. 8,006,605, which is incorporated herein by reference, to Tunis discloses a composite armor panel system that has a strike face assembly and a support and containment assembly joined by a bonding layer. The strike face assembly is formed of a hard material layer, which may be comprised of discrete elements or tiles, and a fiber reinforcement bonded to an inner and/or outer surface of the hard material layer which are encapsulated in a matrix material. The tiles and other materials are essentially joined together via a bonding layer which joins the strike face assembly to the support and containment assembly, and includes a mesh embedded in an adhesive material that minimizes cracks through the bonding layer. Thus, the armor system and connection method of Tunis, while suitable for rigid ballistic and blast resistant applications, is not flexible and relatively expensive.

Furthermore, other presently available systems for blast testing generally comprise a concrete bunker or pit built specifically for that purpose. Under this scenario, a pit is typically built for explosive or blast testing purposes and lined with reinforced concrete or block walls with an energy absorbing internal wall made of a material such as wood or steel panels. These concrete bunkers provide excellent protection against blasts and other explosive forces to be tested. However, such testing systems typically take a substantial amount of time and effort to design, and an even greater amount of time and expense to build. For instance, building such a concrete bunker requires significant expenditures to purchase and transport the building materials, as well as a lengthy period of time to physically build the bunker. Furthermore, some large equipment to be tested or protected would require an extremely large enclosure to be adequately tested, and such enclosures typically do not exist as the amount of time and money necessary to support their construction renders them prohibitively expensive and impractical.

In other cases, there may be a need for pressure or explosive testing at a logistically inconvenient work site requiring sufficient blast protection systems to be first installed, such as on a drilling platform. In such instances, it not suitable to install a permanent test structure such as a concrete testing bunker. Rather, there is a need for a blast protection system that may be quickly setup in a cost effective manner that may still provide adequate blast protection for the facility and personnel on site.

Thus, it can be seen that current technologies for ballistic and blast protection systems either provide insufficient protection for large scale blasts and explosions, or are inappropriate, heavy, and cost prohibitive when the structure or equipment to be protected becomes large. In particular, previously known modular blast protection systems suffer from cumbersome connection methods that are not easily assembled and provide substandard protection at the connection points, typically the weakest points of any blast protection system.

What is therefore needed is a relatively inexpensive, easily constructed blast protection system that is modular, user friendly, and adaptable for use in different locations.

SUMMARY OF THE INVENTION

This invention relates in general to the field of blast control. In various embodiments, flexible barrier products, such as blast blankets and blast curtains, are utilized to provide protection in various environments. The blast control products may be utilized to provide protection from potential failure of, for example, high pressure equipment, in environments such as oil and gas applications, aviation, HVAC and other markets. In some embodiments, the flexible barrier products may be used to provide blast protection enclosures for equipment being pressure tested, whether being tested inside or in the field. A flexible, modular barrier system utilizes an integrated anchoring system allowing barriers to be utilized to segregate or isolate areas or items from one another with or without the use of rigid structure or support. A barrier may be connected back to itself, connected to additional barriers, connected to items to be isolated, or affixed to structure or support systems to form varying barriers and/or enclosure configurations. The barrier system may consist of a blast control blanket and/or other flexible material such as woven wire mesh and may be affixed to a support structure that may be modular, deployable, collapsible, retractable, consist of single or multiple sides and a top, suspended from overhead, utilize a rail system to allow barriers to be retracted horizontally or vertically, utilize hydraulic masts to extend the barrier system into position vertically or horizontally, and/or utilize an articulating handling system to move and deploy the barrier system.

In various embodiments, protective enclosures may be formed around items or objects by placing or wrapping one or more blast control blankets over the object and connecting the blast control blanket back to itself beneath the object, effectively creating a protective barrier between the object and adjacent areas and people and assets nearby. An example of such an embodiment is the use of blast control blankets to wrap frac iron, tubing, lines, valves, unions and various other equipment that is subject to high pressure and therefore poses a potential risk of failure, explosion and/or becoming launched.

In various embodiments blast control blankets may be manufactured into a cylindrical sleeve or tube configuration in order to be slid over items or objects and cinched or anchored at each end to be secured in place to create a protective barrier between the object and adjacent areas and people and assets nearby. Sleeve configurations may have one open end and one closed end, two open ends, or a combination of any number of open and/or closed ends.

In some embodiments blast control blankets may be manufactured into a removable wrap configuration to be situated around objects to form a three hundred-sixty degree enclosure. Such embodiments may be constructed with an integrated closure lacing system, such as, for example, becket lacing.

In various embodiments, structures and equipment may be provided to facilitate deployment of the flexible barrier products. In some embodiments, a partition frame barrier system is provided. In some embodiments, a modular test enclosure system is provided. In some embodiments, a deployable frac barrier system is provided.

In some embodiments, a trolley rail system may be utilized. The rail may be formed from modular aluminum extrusion with a tubular portion that the trolleys traverse. In some embodiments, the trolley rail system may be utilized to suspend flexible blast curtains therefrom. In some embodiments, the framework may include a square aluminum extrusion component, such as the Strongbac framework manufactured by Bomac, to enhance strength and span capabilities.

In some embodiments, blast control blankets may be manufactured into custom equipment covers tailored to be form fitting.

The above summary of the invention is not intended to represent each embodiment or every aspect of the present invention. Particular embodiments may include one, some, or none of the listed advantages.

BRIEF DESCRIPTION OF THE DRAWINGS

A more complete understanding of the method and apparatus of the present invention may be obtained by reference to the following Detailed Description when taken in conjunction with the accompanying Drawings wherein.

DETAILED DESCRIPTION

The present invention is directed towards systems and methods for blast control. In various embodiments, flexible barrier products, such as blast blankets and blast curtains, are utilized to provide protection in various environments. In some embodiments, the barrier system may utilize blast control blankets and methods of securement, such as those described in U.S. Pat. No. 8,573,125 to Rossow et al., the disclosure of which is hereby incorporated by reference. The barrier system may include a blast control blanket connected back to itself, connected to additional barriers or blankets, connected to structural components to be isolated, and/or affixed to a structure or support systems to form a barrier and/or enclosure configured to meet the physical requirements of the environment. The barrier system may consist of a blast control blanket and/or other flexible material such as woven wire mesh and may be affixed to a support structure that may be modular, deployable, collapsible, retractable, consist of single or multiple sides and a top, suspended from overhead, utilize a rail system to allow barriers to be retracted horizontally or vertically, utilize hydraulic masts to extend the barrier system into position vertically or horizontally, and/or utilize an articulating handling system to move and deploy the barrier system.

Figure 1:
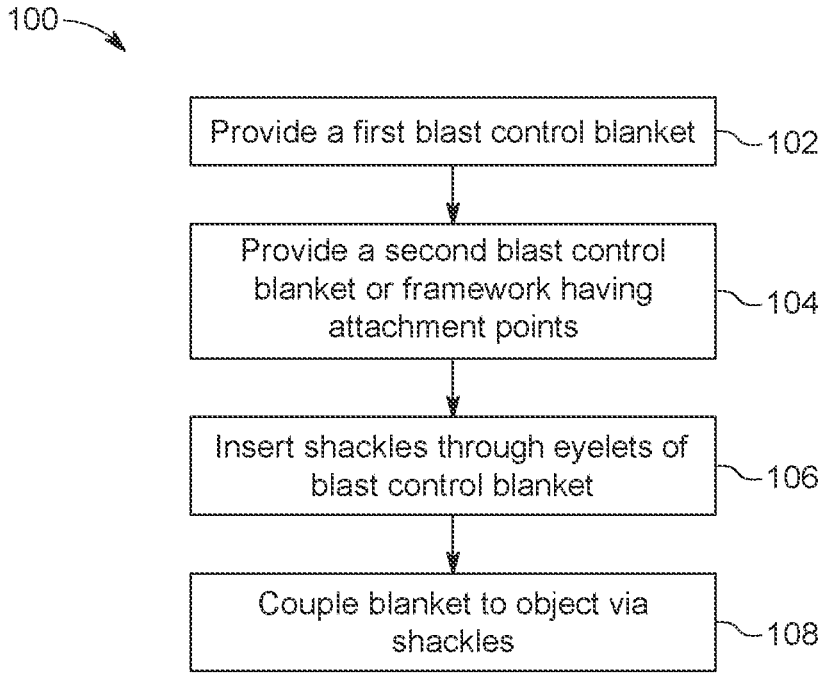
FIG. 1 is a method of attaching a blast control blanket to a frame that may be used in various embodiments.

In some embodiments, a blast control blanket may be coupled to and/or suspended from a framework to provide blast protection. As can be seen, for example, in FIG. 10 of the U.S. Pat. No. 8,573,125, various embodiments may utilize a blast control blanket that includes a cable, for example a steel cable, and/or a rope, such as a synthetic rope, around the perimeter of the blanket and a plurality of eyelets disposed around the perimeter of the blanket to provide attachment points for attaching the blanket to various frameworks and suspension systems. Various methods of securing the blanket to a framework, rail system, structural components, and/or other blankets may be utilized, for example, shackles, high strength carabineers, U-bolts, and/or other anchors to attach the blanket directly to a framework, to a movable trolley, to a cable or rope, and/or to another blanket. Referring now to FIG. 1, a method 100 for coupling a blast control blanket to a framework is provided. At step 102, a blast control blanket is provided having a perimeter cable and eyelets disposed around the perimeter of the blanket to provide attachment points. At step 104, the object to which the blanket will be attached is provided. At step 106, shackles are inserted through the eyelets and around the perimeter wire. At step 108, the shackles are coupled to the object, such as another blanket, a framework, a trolley, or other attachment point.

In various embodiments, a torque lock procedure may be utilized to secure blankets together, such as, for example, as described in U.S. Published Patent Application No. 2016/0040962, which is hereby incorporated by reference. In a first step, two barriers are placed side-by-side either hanging or flat on the ground. A torque pin may be used to assist. The torque pin is positioned behind the perimeter cables to be joined. A second torque pin is then placed behind one cable and in front of the second cable. The second pin is then rotated so the tip rotates over and behind the second cable. After creating a twist in the cables, the second torque pin is placed back through the first slotted cable opening and slid into position so the first torque pin can be removed. One end of the pin is then inserted into the center slot of the torque panel and then the other end of the pin is inserted into the slot. Other systems and methods of securing one or more panels to each other and/or to a structure may be utilized.

In various methods of securing a blast control blanket, the blast control blanket may be affixed to a trolley, such as the trolley and rail system disclosed in Australian Patent Application No. AU 201126552, which is incorporated herein by reference. In some embodiments, a shackle may be utilized to couple the perimeter cable of a blast control blanket to a trolley affixed to a rail system. In some embodiments, a plurality of shackles may couple the blast control blanket to a rail system. In various embodiments, extension cables may be employed to ensure the blanket is disposed at the correct height, for example, to touch the ground and/or to facilitate anchoring the bottom edge of the blanket to the ground and/or a lower portion of the framework. In various embodiments, the framework may be a free standing framework that may, for example, be anchored to the ground or concrete floor. The framework and/or rail system may be anchored to a building or suspended from an overhead structure.

Figure 2A:
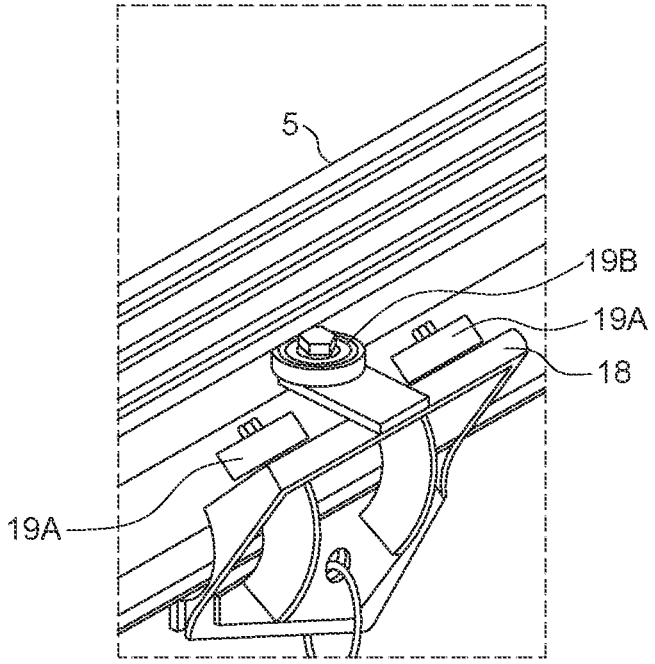
FIG. 2A is a diagram of a trolley and rail system that may be utilized in various embodiments.
Figure 2B:
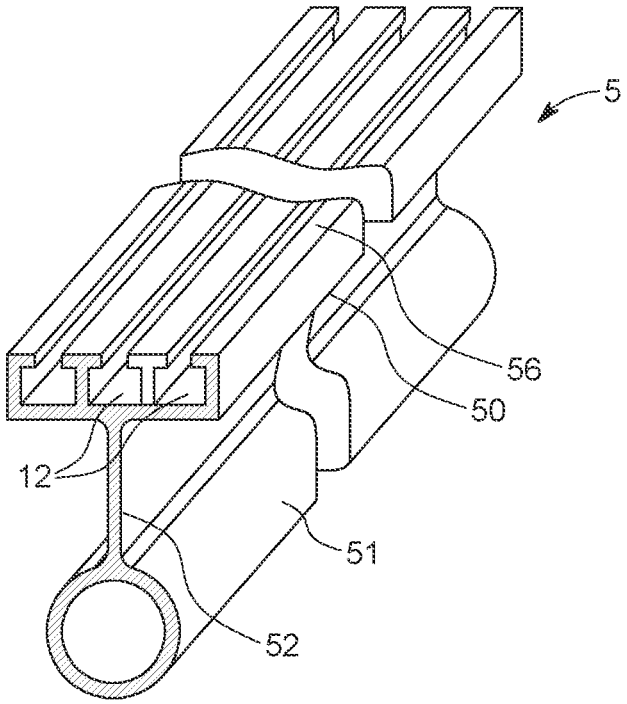
FIG. 2B is a diagram of a rail system that may be utilized in various embodiments.

Referring now to FIGS. 2A and 2B, an implementation utilizing a trolley and rail system to provide ease of deployment of the blast control system, such as, for example, the trolley and rail system disclosed in AU 201126522, is provided. The trolley 18 may have a plurality of rollers 19A and 19B for rolling on the rail system 5. In some embodiments, the rail 5 may be formed from modular aluminum extrusion with a tubular portion 51 that the trolleys may travel along. In some embodiments, the trolley rail system may be utilized to suspend flexible blast curtains therefrom. In some embodiments, the trolley may have four angled rollers (19A) to allow the blast control blanket to swing from side to side, which may provide additional energy absorption by the blanket. In some embodiments, in addition to the four angled rollers, the trolley may have two rollers (19B) abutting the rail surface to provide additional stability and side load strength. In various embodiments, the trolleys may have any number of rollers depending on the needs of the environment. The trolley may be comprised of two halves bolted together to allow trolleys to be added to or removed from anywhere along the track without having to remove other trolleys. In some embodiments, the trolleys may be motorized to provide automation—both laterally along the track and vertically to hoist blast control blankets attached thereto. In some embodiments, the track on which the trolleys roll may have curves, bend, elbows, 90-degree turns, and/or 180-degree turns. In some embodiments, trolleys running along a first set of tracks may be coupled to an additional track having one or more trolleys running thereal-long. In such embodiments, the trolleys and tracks may be configured similar to a mobile gantry crane such that a blanket suspended from trolleys on the lower track may be moved in a plurality of directions. The tracks may be permanently mounted to a structure or may be temporarily suspended while blast protection is needed. In some embodiments, a retrofit for securing openings may be provided using the trolleys and tracks and blast control blankets. In such embodiments, the tracks may be installed around a perimeter of a building or other enclosure having an open surface needing to be closed. A blast control blanket may be coupled to trolleys so the opening can be enclosed. For example, in some embodiments a three-sides or "U-shaped" structure made of concrete or other material having a blast door across the open end of the structure may need a blast roof installed. Preferably, the blast roof should be removable to allow cranes or other machinery to enter the enclosure. In such embodiments, the rail system may be secured (for example, using I-beams) along the top of the U-shaped building so that a blast control blanket coupled to trolleys can be deployed and retracted across the span as needed.

Figure 3:
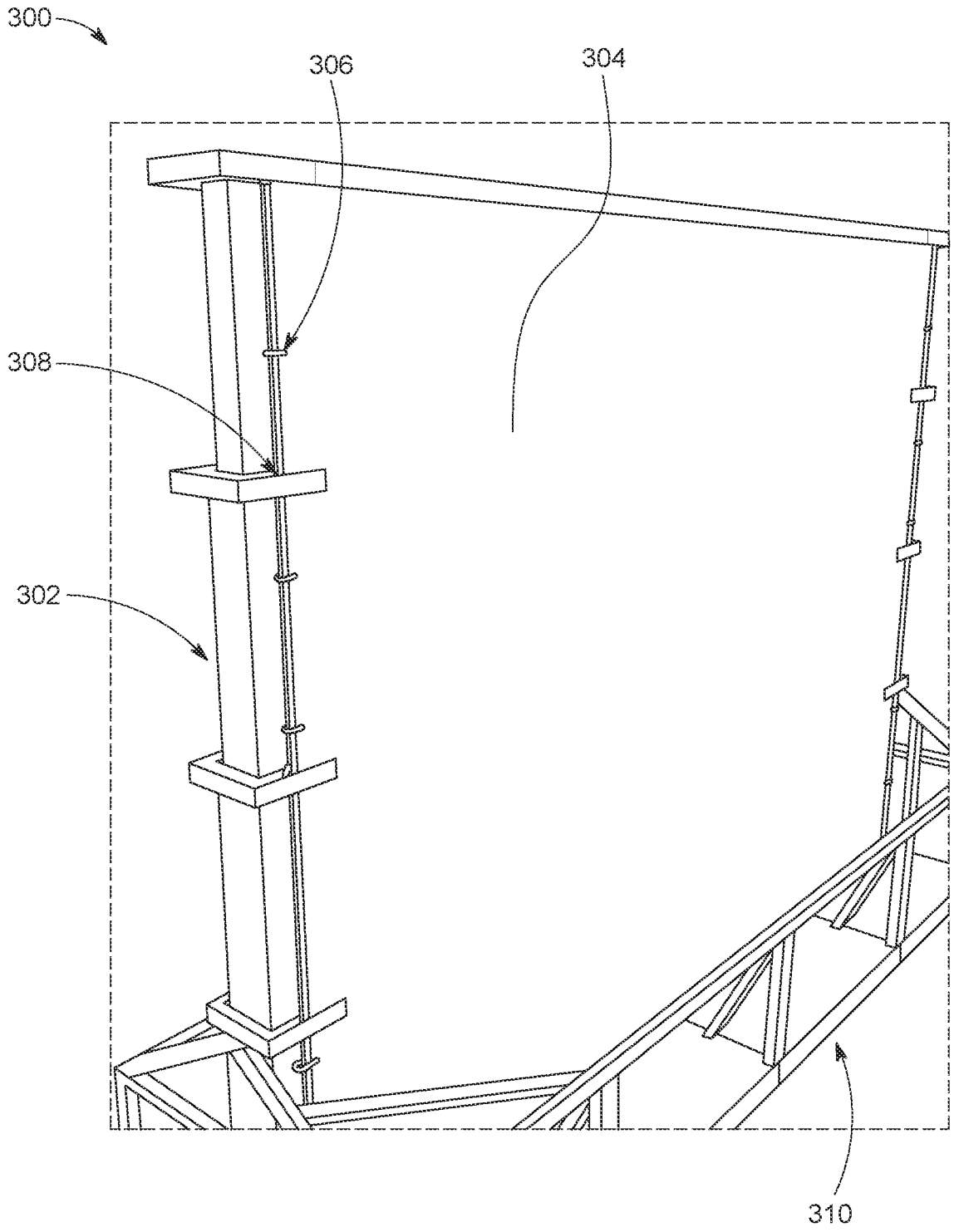
FIG. 3 is a drawing of an embodiment of a deployable frac barrier system.

Referring now to FIG. 3, an embodiment of a deployable barrier system 300 is shown. In the embodiment shown, the system may be delivered to an environment needing blast control as a self-contained system having a blast control blanket 304 and an expandable framework 302. In some embodiments, the framework may be a collapsible structure system that expands vertically to provide a perimeter to secure the blast control blanket. In some embodiments, the framework may be deployed vertically using a hand-crank, motor, crane, or other method. In the embodiment shown, the deployable barrier system may utilize integrated hydraulic masts 302 to raise the blast control blanket 304 to the appropriate height. The masts may be attached to a modular base section 310 to facilitate delivery and deployment. The barrier may be placed, for example, between wellheads on multi-well pads to allow work to continue on wells while an adjacent well is under pressure. The top span member may be attached to the top of the two side masts to provide structural integrity and places for securing the blast control blanket. In some embodiments, U-bolts 306 or other means of attachment may be utilized to secure the blanket to the base section, top span and/or the side masts. In some embodiments, a cable may be attached between the top span and the base section and routed through and/or secured to the eyelets on the blast control blanket 304. In some embodiments, the cable may be coupled to the side masts and/or the blanket may be secured directly to the side masts 308. Additional bracketry and structural members can be connected to the parallel masts in order to form a "U" shape around the well head, or even a complete enclosure.

In various embodiments of a deployable barrier system, the deployable barrier system may be utilized, for example, where a relatively narrow space exists between two environments needing to be protected, such as in a hydraulic fracturing operation. For example, an engineered barrier may be placed between wellheads on multi-well fracs to allow work to safely continue on wells while an adjacent well is under pressure resulting in reduced non-productive time and enhanced safety. The system may be delivered utilizing a crane and placed where needed. In other embodiments, the system may include wheels and/or may be delivered using a forklift or other means.

In some embodiments, a modular test enclosure system may be provided that includes a framework around which blast control blankets may be secured. In some embodiments, a bottom surface may be open and a top surface may be open and/or covered with a blast control blanket. In some embodiments, the framework may be assembled around a device or area to be secured or the framework may be pre-built and then placed over the device or area to be secured. In some embodiments, a single blanket may be sized to wrap around the entire framework or multiple blankets may be utilized and secured to the framework and each other using, for example, the torque-lock procedure described below. While the enclosure may have a generally cubic shape, other embodiments may be rectangular, triangular, cylindrical, or other shape. The framework may be relatively lightweight and can be lifted from overhead via overhead crane or other means to be placed over items subject to high pressure or potential failure or blast. In alternative embodiments of a modular test enclosure system, one or more blast control blankets may be coupled to an upper framework. The upper framework may be suspended from above or may include legs to elevate the upper framework to a correct height. The upper framework may include a motor, crank, or other means of raising and lowering the side blankets. For example, guidewires may be coupled to the side blankets such that, when the guidewires are retracted, the blast control blankets are raised to provide ease of access to the area beneath the upper structure. In some embodiments, one or more surfaces of the enclosure may utilize blankets coupled to trolleys to allow the blankets to be opened and closed. In some embodiments, the sides of the enclosure may be collapsible to expand or reduce the protected area.

In alternative embodiments of a modular test enclosure system, an enclosure utilizing a blast control blanket may be deployed using an extendible arm. The extendible arm may include a vertical arm that can be raised and lowered and a lateral arm that can be rotated and extending to deploy the enclosure. When the enclosure is needed, the four arms may be extended to expand the perimeter of the enclosure and lower the blast control blankets. In other embodiments, the enclosure may be suspended from an upper structure. In some embodiments, extending the four arms may also cause the blankets to lower while, in other embodiments, the blankets may be raised and lowered independent of the four arms.

Figure 4:
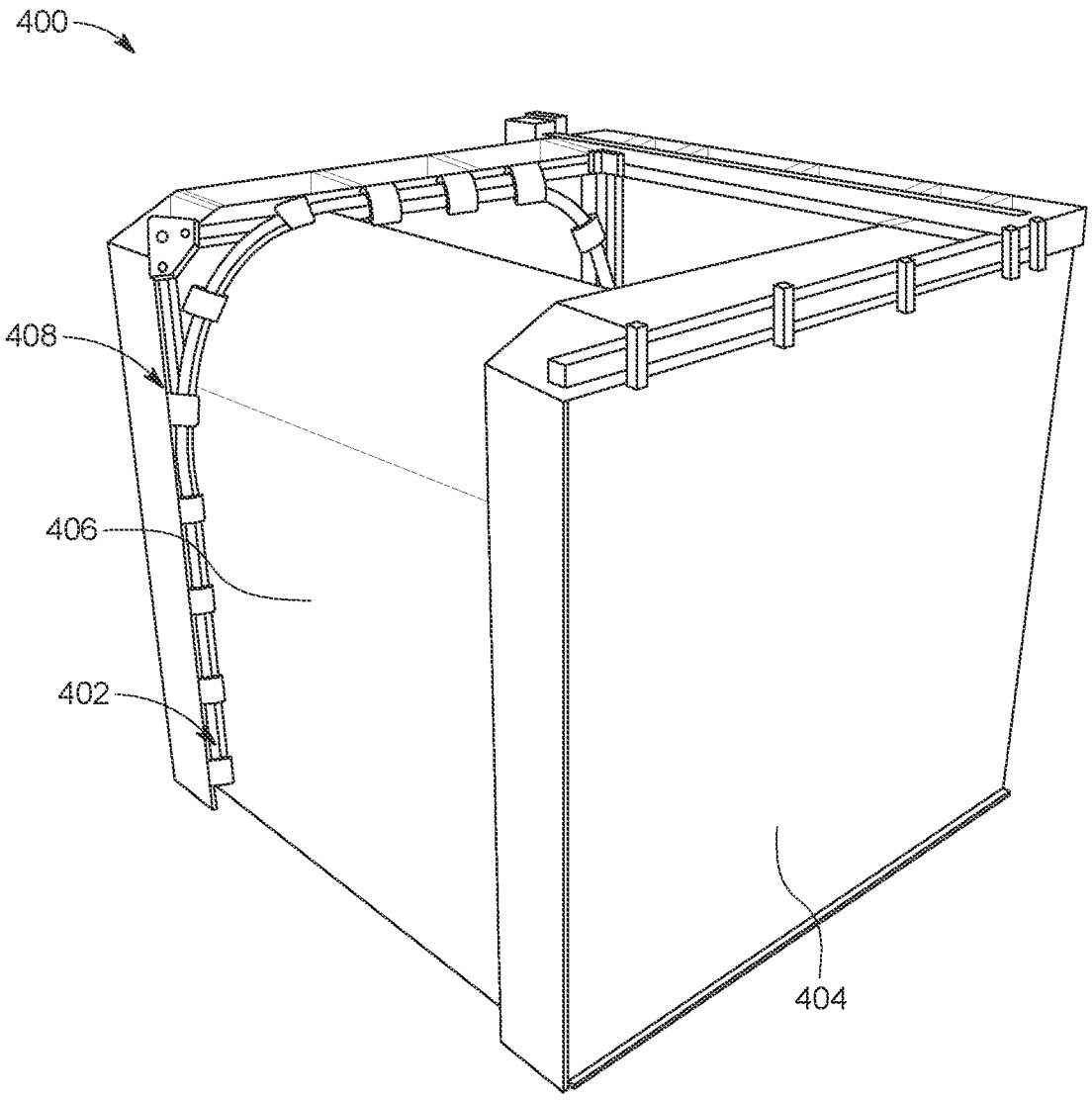
FIG. 4 is a drawing of an embodiment of a modular test enclosure system.

Referring now to FIG. 4, an alternative embodiment of a modular test enclosure system 400 is shown. In the embodiment shown, a cube or other shape may be formed having blast control blankets 404 secured around three sides thereof. In some embodiments, a bottom surface may be open, secured to a base, secured to the ground or floor, and/or have a blast control blanket secured thereto. As can be seen, a blast control blanket 406 has been secured to trolley 408 coupled to two oppositely disposed rails 402. In such embodiments, an item, such as a pressure vessel or other device needing to be secured or pressure tested, may be placed inside the enclosure and then the enclosure may be closed by extending the blast control blanket 406 along the rails 402 that makeup the roof and front door. In the embodiment shown, a combination retractable door and roof travel along the rails in unison, allowing transport of objects to and from the enclosure via overhead crane, forklift, or other means. The blast control blanket may have a first side that remains secured to the framework in both the open and closed position, second and third oppositely disposed sides secured to trolleys, rollers, etc. to facilitate opening and closing of the blanket, and a fourth side that is secured to the framework when in the closed position. In some embodiments, stays or other cross members may be included to provide support for the blast control blanket or wire mesh that provides the door and/or roof barrier. In some embodiments, one or more of the rollers or stays may be motorized or couples to guidewires to facilitate opening and closing of the enclosure. While the embodiment shown has two sides that are openable, in some embodiments, one, two, three or more sides may be open and closed.

Figure 5:
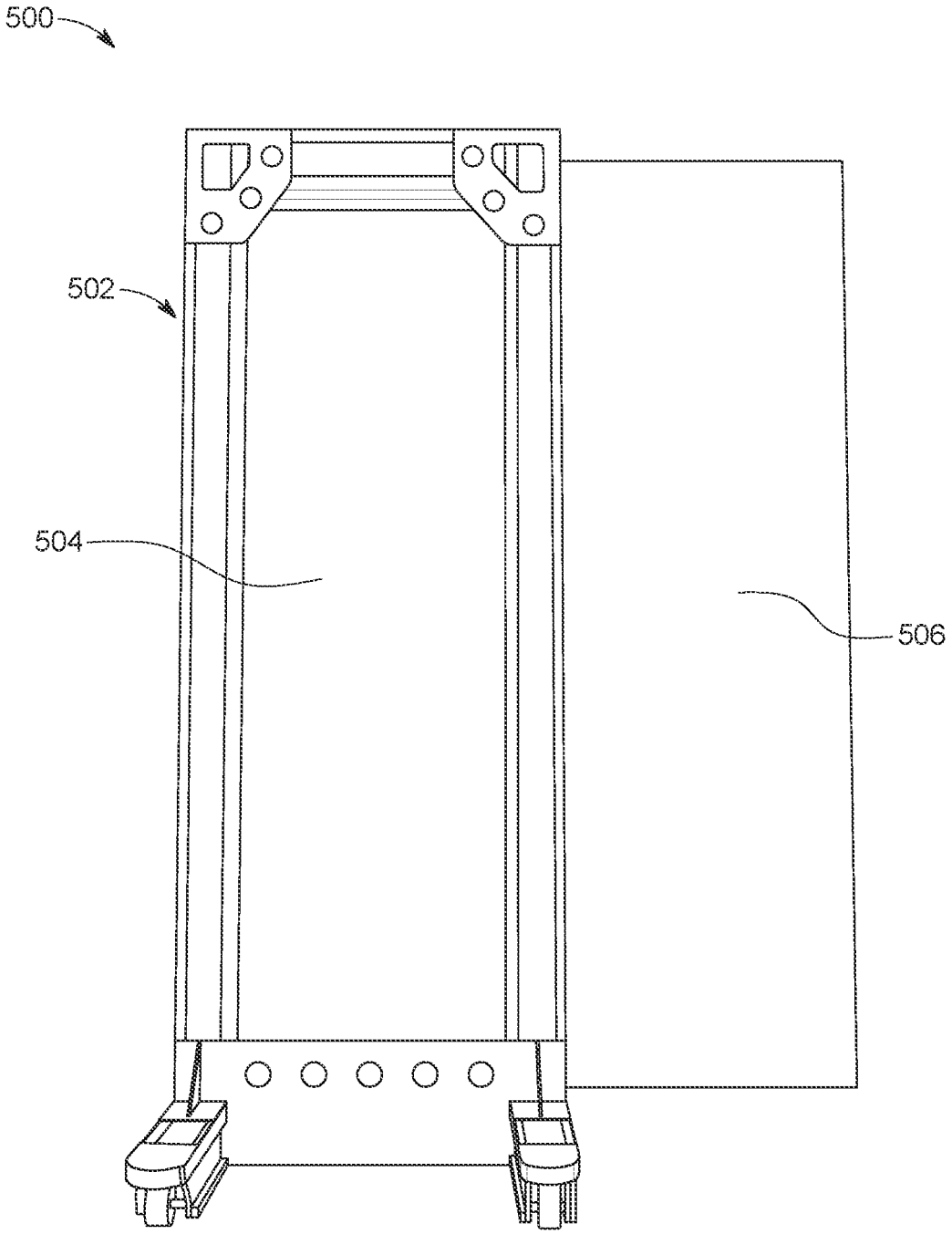
FIG. 5 is a drawing of an embodiment of a partition frame barrier system.

Referring now to FIG. 5, an embodiment of a partition frame barrier system 500 is shown. FIG. 5 shows a blanket 504 secured to a standalone framework 502 for deployment as a blast screen. In some embodiments, the partition frame barrier 500 may include framework 502 that comprises square aluminum extrusion components, such as the Strongbac framework manufactured by Bomac, to enhance strength and span capabilities. The legs of the partition may be coupled to perpendicular extensions to provide stability. In some embodiments, guidewires may also be utilized to provide further resistance against lateral forces. In some embodiments, a plurality of partition frame barriers 500 may be utilized. Each partition may have a blast control blanket 504 secured therein, wherein the surface area of the blast control blanket is larger than the surface area of the frame such that the excess area 506 of the blanket of a first partition may be secured to the frame and/or blanket of a second partition. The partition frame barrier is designed to be portable and modular as multiple barriers can connect in order to increase the protection required for a facility.

Figure 6:
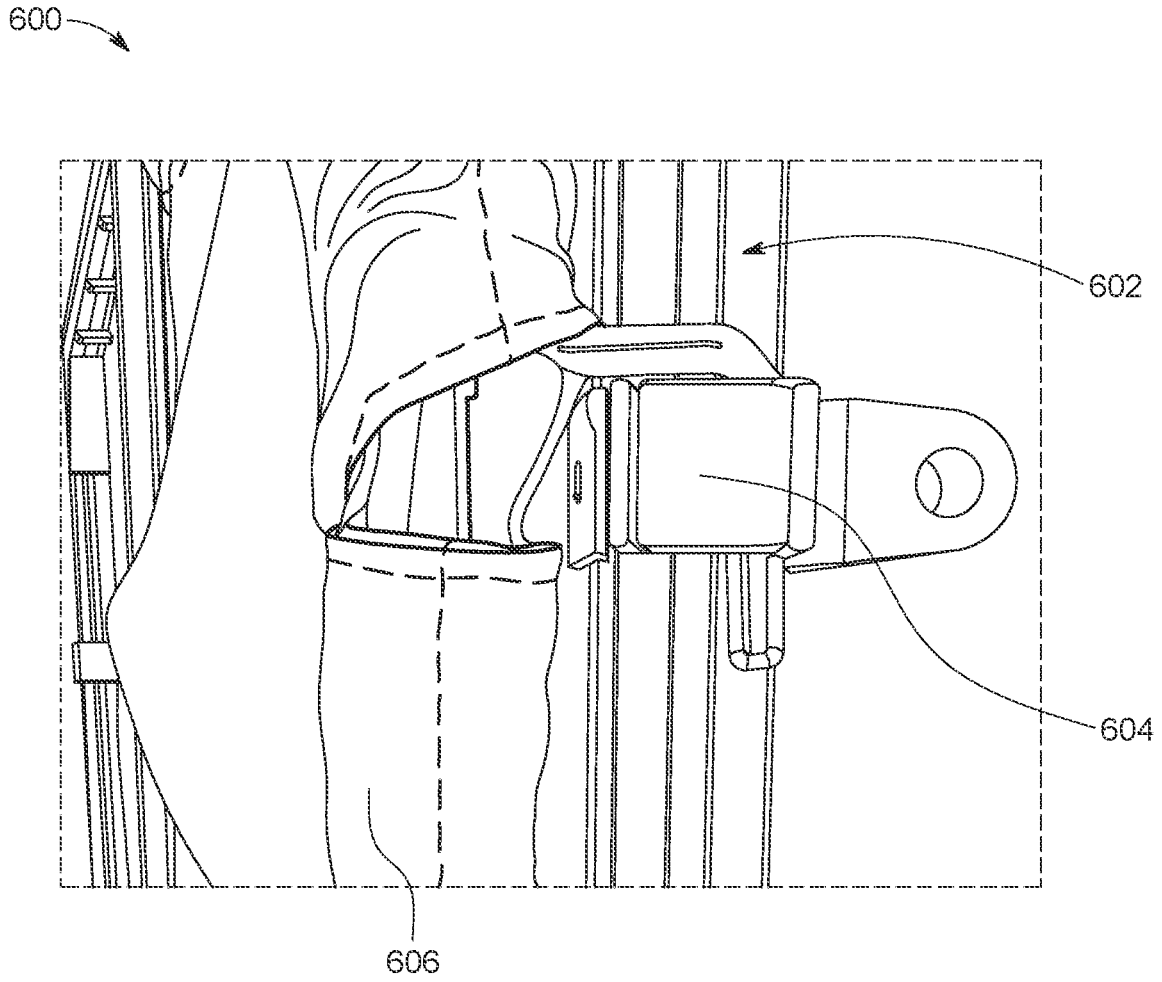
FIG. 6 is a drawing of an embodiment of a partition frame barrier system.

In various embodiments of the partition frame barrier system 500, two partitions may have a single blanket secured thereto or a blanket may be secured to each partition and then the blankets and/or frames may be secured to each other. Referring now to FIG. 6, a partition frame barrier system 600 is shown wherein an outer edge of the blast control blanket 606 contains a lockbar having angled protrusions 602 extending outwardly therefrom. The protrusions 602 are configured to matingly engage with slots, brackets, or other receptacles 604 connected to a framework of a partition. In that way, the protrusions can matingly engage the slots to securely a first partition to a second partition. In some embodiments, the partitions may have wheels mounted thereon to facilitate deployment. The wheels may be locked and/or the partition may be secured to the ground or other structure either directly or via guidewires. The two partitions may be placed at an angle to one another to provide additional resistance to lateral forces. In some embodiments, a tri-fold partition having a single blanket secured across three partitions may be provided and/or a plurality of blankets coupled to each other and/or to the frameworks of one or more partitions. In various embodiments of the partition frame barrier system, a plurality of partitions having one or more blankets secured thereto may be provided and the partitions may be arranged in a U-shape or in a circular shape and secured using an additional framework. In the various embodiments, each partition may have a blanket secured thereto, wherein the blanket extends past the edge of the partition such that the extended edge of the blanket may be attached to the next blanket and/or framework in the circle to form a unitary structure. In some embodiments, some blankets may be secured to the partition with no excess blanket while others may be secured to the partition at or near a midpoint such that portions of the blanket extend from two oppositely disposed sides of the partition. In such embodiments, the unitary structure may be formed by alternating between partitions with no excess blanket and partitions with blankets extending from two sides. In some embodiments, a single blanket may be secured to a plurality of partitions.

The blast control systems described herein may be utilized to provide protection from potential failure of, for example, high pressure equipment, in environments such as oil and gas applications, aviation, HVAC, and other markets. For example, some embodiments of the flexible barrier systems may be used to provide blast protection enclosures for equipment being pressure tested, whether such tests are being conducted inside an enclosure or in the field. The flexible, modular barrier systems described herein may utilize an integrated anchoring system allowing barriers to be utilized to segregate or isolate areas or items from one another with or without the use of rigid structures or supports. Various embodiments of the blankets, structures, frameworks, trolleys, rails, attachments, and deployment systems described herein, including various modifications and combinations thereof, may be utilized to facilitate deployment of flexible barrier systems, partition frame barrier systems, modular test enclosure systems, and deployable barrier systems.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention.

What is claimed is:

1. A system for providing portable blast control partitions comprising:

a first blast control partition comprising:

a framework comprising a pair of spaced apart uprights, an upper beam extending between an upper end of the pair of uprights, and a lower beam extending between a lower portion of the pair of uprights;

a blast control blanket having first and second horizontal edges and first and second vertical edges, the blast control blanket being coupled to the framework, wherein the first vertical edge of the blast control blanket is securely coupled to a first upright of the pair of uprights, at least a portion of the first and second horizontal edges are securely coupled to the upper and lower beams, and the second vertical edge extends beyond a second upright of the pair of uprights;

a second blast control partition comprising:

a framework comprising a pair of spaced apart uprights, an upper beam extending between an upper end of the pair of uprights, and a lower beam extending between a lower portion of the pair of uprights;

a blast control blanket having first and second horizontal edges and first and second vertical edges, the blast control blanket being coupled to the framework, wherein the first vertical edge of the blast control blanket is securely coupled to a first upright of the pair of uprights, at least a portion of the first and second horizontal edges are securely coupled to the upper and lower beams, and the second vertical edge extends beyond a second upright of the pair of uprights;

wherein the second vertical edge of the blast control blanket of the first blast control partition is securely coupled to the first upright of the framework of the second blast control partition.

2. The system of claim 1 and further comprising a lock bar disposed within the second vertical edge of the blast control blanket, the lock bar having an angled protrusion extending outwardly from the second vertical edge of the blast control blanket.

3. The system of claim 2, wherein the angled protrusion extending outwardly from the second vertical edge of the blast control blanket is configured to be inserted into a receptacle on the first upright of the framework of the framework of the second blast control partition.

4. The system of claim 1 and further comprising extensions perpendicular to the lower portion of the pair of uprights and the lower beam.

5. The system of claim 4 and further comprising a plurality of wheels coupled to the extensions.

6. A blast control partition comprising:

a moveable framework comprising a pair of spaced apart uprights, an upper beam extending between an upper end of the pair of uprights, and a lower beam extending between a lower portion of the pair of uprights, wherein the uprights are spaced apart a first distance and the upper beam is spaced apart from the lower beam a second distance;

a blast control blanket having first and second vertical edges defining a height of the blast control blanket and first and second horizontal edges defining a length of the blast control blanket;

wherein the first vertical edge of the blast control blanket is securely coupled to a first upright of the pair of uprights, a portion of the first horizontal edge is securely coupled to the upper beam, and a portion of the second horizontal edge is securely coupled to the lower beam;

wherein the height of the blast control blanket is approximately equal to the second distance and the length of the blast control blanket is greater than the first distance such that the second vertical edge of the blast control blanket extends beyond a second upright of the pair of uprights; and wherein the second vertical edge includes an opening having an angled protrusion extending outwardly from the opening to facilitate the blast control blanket being secured to an object.

7. The blast control partition of claim 6, wherein the angled protrusion extending outwardly from the second vertical edge of the blast control blanket is configured to be securely coupled to a receptacle connected to a second framework.

8. The blast control partition of claim 6 comprising:

a pair of extensions perpendicular to the lower portion of the pair of uprights and the lower beam.

9. The blast control partition of claim 8 and further comprising a plurality of wheels coupled to the extensions.

10. A method for providing portable blast control partitions comprising:

providing a first blast control partition comprising:

a framework comprising a pair of spaced apart uprights, an upper beam extending between an upper end of the pair of uprights, and a lower beam extending between a lower portion of the pair of uprights;

a blast control blanket having first and second horizontal edges and first and second vertical edges, the blast control blanket being coupled to the framework, wherein the first vertical edge of the blast control blanket is securely coupled to a first upright of the pair of uprights, at least a portion of the first and second horizontal edges are securely coupled to the upper and lower beams, and the second vertical edge extends beyond a second upright of the pair of uprights;

providing a second blast control partition comprising:

a framework comprising a pair of spaced apart uprights, an upper beam extending between an upper end of the pair of uprights, and a lower beam extending between a lower portion of the pair of uprights;

a blast control blanket having first and second horizontal edges and first and second vertical edges, the blast control blanket being coupled to the framework, wherein the first vertical edge of the blast control blanket is securely coupled to a first upright of the pair of uprights, at least a portion of the first and second horizontal edges are securely coupled to the upper and lower beams, and the second vertical edge extends beyond a second upright of the pair of uprights; and coupling the second vertical edge of the blast control blanket of the first blast control partition to the framework of the second blast control partition.

11. The method of claim 10 comprising:

wherein a lock bar is partially disposed within the second vertical edge of the blast control blanket of the first blast control partition, the lock bar having an angled protrusion extending outwardly therefrom.

12. The method of claim 11, wherein the coupling comprises inserting the angled protrusion into a receptacle of the framework of the second blast control partition.

13. The method of claim 10, wherein the framework of the first blast control partition comprises a pair of extensions perpendicular to the lower portion of the pair of uprights thereof and to the lower beam thereof.

14. The method of claim 13, wherein the extensions comprise a plurality of wheels coupled thereto.

* * * * *